United States Patent [19]

Trinh et al.

[11] Patent Number: 4,493,307

[45] Date of Patent: Jan. 15, 1985

[54] ADVANCE CONTROL FOR BREAKERLESS IGNITION SYSTEM

[75] Inventors: Lanh T. Trinh, San Diego, Calif.; Robert W. Loy, Granger, Ind.

[73] Assignee: The Bendix Corporation, Southfield, Mich.

[21] Appl. No.: 517,170

[22] Filed: Jul. 25, 1983

[51] Int. Cl.[3] ..... F02P 5/00

[52] U.S. Cl. ..... 123/630; 123/618; 123/640; 307/234

[58] Field of Search ..... 123/599, 602, 643, 630, 123/618, 415; 307/234; 328/120

[56] References Cited

U.S. PATENT DOCUMENTS

| | | | |
|---|---|---|---|
| 3,741,184 | 6/1973 | Tanner et al. | 123/630 |
| 3,906,258 | 9/1975 | Moe | 307/234 |
| 4,069,801 | 1/1978 | Stevens | 123/640 |
| 4,112,895 | 9/1978 | Habert | 123/415 |
| 4,138,977 | 2/1979 | Grather et al. | 123/630 |
| 4,201,173 | 5/1980 | Okada et al. | 123/640 |
| 4,228,778 | 10/1980 | Rabus et al. | 123/640 |

*Primary Examiner*—Parshotam S. Lall
*Attorney, Agent, or Firm*—Ken C. Decker

[57] ABSTRACT

A breakerless ignition system in which an electronic advance circuit (30) generates an electrical trigger signal (SPKE) and a mechanical advance circuit generates a mechanical trigger signal (PCP). The mechanical trigger signal (PCP) and electrical trigger signal (SPKE) are combined in a trigger circuit (28) to generate an activation signal to a power switching device (40) which causes an ignition circuit (32) to fire a spark plug (54). In operation the electrical trigger signal (SPKE) normally provides an accurate timing signal to ignite the plug (54) and the trigger circuit (28) masks the mechanical trigger signal (PCP) to prevent double firing. Upon failures or special conditions when the (SPKE) signal is absent the (PCP) signal will provide operation in a back-up mode to ignite plug (54).

7 Claims, 13 Drawing Figures

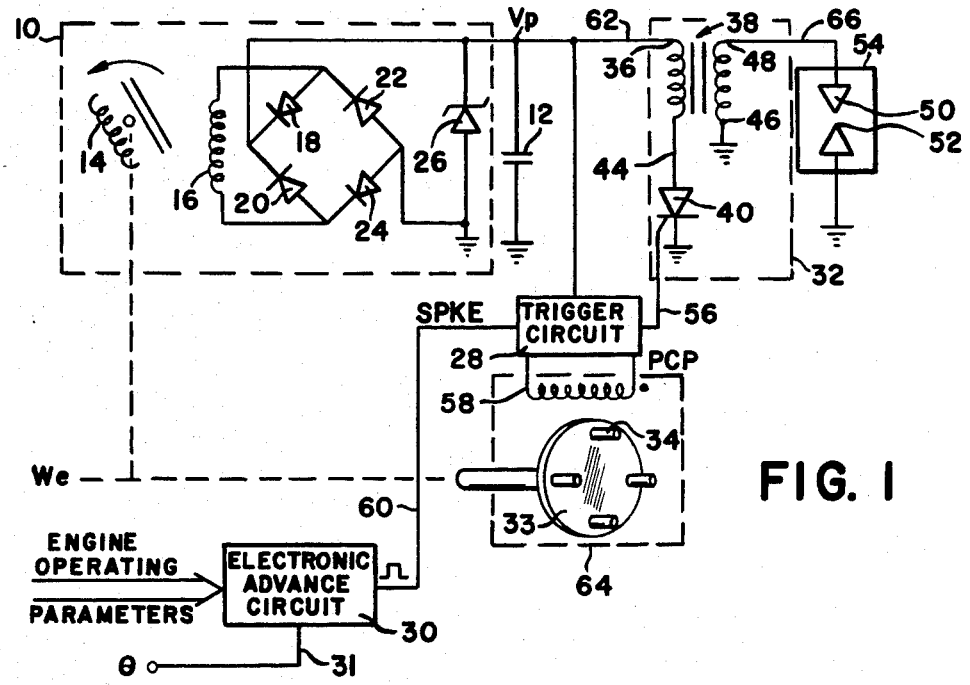
FIG. 1
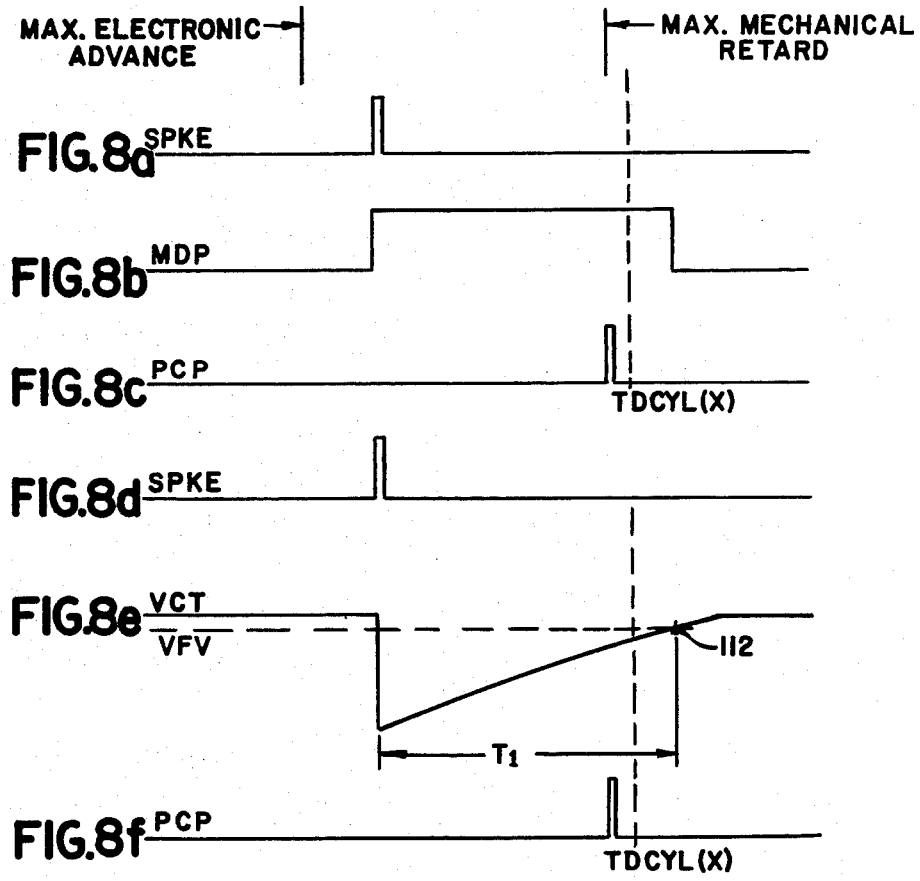

ADVANCE CONTROL FOR BREAKERLESS IGNITION SYSTEM

The invention relates generally to an electronic advance control for a breakerless ignition system and more particularly to an advance control in which an accurate electronic advance system is interfaced with a mechanical advance system.

Breakerless ignition systems for internal combustion engines are conventionally known. In these systems the points of a standard ignition system are replaced by a solid state power switching device most commonly a silicon controlled rectifier (SCR) or a power transistor. The power switching device is triggered electronically to provide a current path between a source of energy and the primary inductance of an ignition coil. The pulse of current in the primary caused by switching the power device induces in the secondary inductance of the ignition coil a high tension which will arc across the gap between the electrodes of a spark plug thus igniting a combustible charge in the cylinder of an engine.

The timing of the activation of the switching device is critical to the operation of the engine being ignited. Normally, the timing of the power switching device is set to a predetermined advance before some reference point, usually top dead center of the compression stroke of the cylinder being ignited when the engine is four-cycle or two-cycle. This requires a physical measurement of the actual crankshaft angle at which the engine is operating to direct the timing. In most prior art systems a pickup coil that senses the passage of a physically rotating element (magnet pin) linked to the engine crankshaft by gearing or such is used to generate a pulse at the correct engine angle to thereby activate the power switching device. This trigger means which is mechanically timed can be disadvantageous for a number of reasons.

Initially, when relying on the mechanical passage of a magnet pin past a coil for timing purposes, the accuracy of the spark control suffers to the extent that the mechanical linkage between the crankshaft and the rotating element do not maintain a fixed relationship. Gearing backlash and tolerances in the connection therefore affect timing accuracies.

Timing or the degree of ignition advance in these mechanisms is set by rotating a plate on which the pickup coil for each cylinder is mounted. By varying the initial angular relationship between the magnet pin and each coil more or less angular advance can be provided by the mechanism. The ignition advance in these systems can be either variable or fixed depending upon application. With a fixed relationship, the plate is adjusted to a set relationship when the engine is timed and then a set screw is tightened to maintain the position. In a variable advance system, the plate is moved by a servomechanism to adjust ignition timing to an optimum position based upon operating conditions of the engine.

In both of these configurations timing accuracy is difficult to obtain or maintain. Modern internal combustion engines necessitate different advance settings for different operating conditions which make the fixed plate system disadvantageous. Fixed settings also deteriorate due to aging, component wear, tolerance changes, etc. Even when the variable setting systems incur inaccuracies because of the time lag in adjusting the plate to the desired position of advance for changing operating conditions and the inherent deviation errors in mechanical servosystems. Moreover, because of the mechanical tolerances and the backlash in the gearing rotating the triggering element, these systems tend to walk around a set point never really accurately coming to rest at the optimum point. With these mechanical triggered systems the accuracy of ignition advance within several degrees of the optimum is considered all that is obtainable.

In addition to the accuracy problem, the fixed and variable plate ignition systems are based on a premise that is only substantially true. The premise is, at a particular engine operating point, all engine cylinders are identical and therefore all cylinders will necessitate the same degree of advance. Of course, the fact is that each cylinder of an engine is different (an individual engine in and of itself) and will require a different advance from any other cylinder for optimum operating performance. This is particularly true where the cylinders are of a large displacement such as in stationary industrial applications.

Accordingly, the present invention solves these problems by providing an electronic ignition advance system interfacing with a breakerless ignition system which is capable of firing each cylinder of an engine accurately and at a different advance from any other cylinder. The configuration eliminates the inaccuracies of the mechanical advance systems and provides a system that can advantageously operate closer to a scheduled set point. Additionally, the electronic advance can be used to set scheduled ignition points for each cylinder, thereby providing an overall increase in operating efficiency. Additionally, the electronic ignition advance system operates to mask the ignition triggerig from a mechanical advance system while the electronic system is operational.

This dual system is advantageous because upon a failure of the electronic ignition advance, the breakerless ignition system will revert to a back-up mode with the mechanical advance.

Another advantage of this dual system is that the mechanical advance can be requested by muting the electronic advance for special conditions such as starting or manual operation. The special condition of starting would be initiated by a fixed mechanical advance which is optimum for starting the engine and the electronic ignition advance generated to take over ignition control only when the engine had attained an operating speed. Manual operation would occur when it is necessary to service the electronic advance system and the engine cannot be shut down during the overhaul period.

Therefore, the invention comprises a breakerless ignition system having an ignition coil with a primary winding for receiving a controlled pulse of current and a secondary winding for transforming the current pulse into a high voltage pulse capable of arcing across the gap between the electrodes of a spark plug. A controlled power switching device having a control electrode is disposed between a power source and the primary winding to generate the current pulse during the time it is activated.

The system further has a means for activating the controlled power switching device via its control terminal with a mechanical trigger signal and an electrical trigger signal, a means for generating the mechanical trigger signal, and a means for generating the electrical trigger signal.

The means for generating an electrical trigger signal includes an electronic control unit (ECU) adapted to sense engine operating parameters and an exact angular representation of engine position. The ECU stores a map of ignition advances and schedules the electrical trigger point from the operating parameters and engine position for each cylinder. The ECU thereafter generates the electrical trigger signal as a train of pulses indicating exactly when each cylinder should be ignited.

In the preferred form the activating means comprises a second controlled switching device with a control electrode which is disposed between a second power source and the control terminal of the first controlled switch. In response to the electrical or mechanical trigger signals, the second switching device connects the second power source to the control electrode of the power switching device thereby activating it.

In a first implementation of the activating means the second controlled switch comprises a photosensitive SCR of an Opto-SCR device. A mechanical trigger signal for the SCR is provided by a pickup coil connected between the gate terminal and the cathode of the device. The pickup coil generates a firing pulse upon the passage of a physical timing element past the coil whose position is indicative of a particular engine crankshaft angle. An electrical trigger signal is provided by a timed pulse from the Electronic Control Unit and is applied to a monostable multivibrator and a conditioning circuit. The astable generates a delay pulse which stretches the timing pulse and triggers the SCR through a light emitting diode (LED) of the Opto-SCR. The length of the delay pulse holds the SCR in conduction until after the mechanical pulse is generated thereby preventing more than one actuation per cycle.

In a second implementation the second switching device comprises a SCR. The mechanical trigger signal is applied by a pickup coil similarly connected as in the first implementation. The electrical trigger signal is provided by a timed pulse from the Electronic Control Unit and is applied to the primary of a pulse transformer whose secondary is paralleled with the coil of the mechanical pickup. Additionally, the timed pulse is applied to a monostable multivibrator and a conditioning circuit which generates a delay pulse. The delay pulse is applied to the control terminal of the power switching device to hold it in conduction until after a mechanicai pulse is generated by the pick up coil, thereby preventing more than one actuation per cycle.

In a third implementation, the second switching device again comprises an SCR. The mechanical trigger signal is generated by a pickup coil similarly connected as in the first and second implementations. The electrical trigger signal is generated by a photosensitive transistor of an opto-transistor connected between the gate and anode terminal of the SCR and a third power source. A timed pulse is applied to conditioning circuitry which causes conduction of the LED of the opto-transistor to turn on its transistor and thereby trigger the SCR. The second power source in the third implementation is preferably a capacitor charged through an impedance having a predetermined RC time constant. The time constant is chosen to inhibit retriggering of the second switching device until after the mechanical pulse is generated.

These three implementations illustrate an activating means which is responsive to either an electrical trigger signal or a mechanical trigger signal. In the application of all these implementations, if the electrical trigger signal is absent, such as when the Electronic Control Unit fails or during special conditions such as starting or service outages, the mechanical trigger signal will ignite the cylinder at the mechanical advance. During other times when the electrical trigger signal is present, the cylinder will be ignited at the electrical advance time and the mechanical advance trigger masked to prevent double firing.

Three system implementations of the advance system are illustrated for multicylinder application. In the first multicylinder embodiment a plurality of electrical and mechanical trigger signal pairs are generated by the Electronic Control Unit and distributed electrically to a plurality of associated activating means, power switching devices, ignition coils, and spark plugs. A second multicylinder embodiment illustrates that a single activating means can be used to activate a plurality of power switching devices and their associated ignition coils and spark plugs via a mechanical distributor. Finally, a third multicylinder embodiment discloses the mechanical distribution of the high voltage pulse from the secondary of an ignition coil to a plurality of spark plugs.

These and other objects, features, and aspects of the invention will be more clearly understood and better described if a reading of the detailed description is undertaken in conjunction with the appended drawings wherein:

BRIEF DESCRIPTION OF THE DRAWINGS

FIG. 1 is a detailed electrical schematic diagram of a breakerless ignition system constructed in accordance with the invention;

FIGS. 8*a–f* are all pictorial waveform diagrams of signals at various positions in the trigger circuits illustrated in FIGS. 5–6.

DETAILED DESCRIPTION OF THE PREFERRED EMBODIMENT

Figure 2:
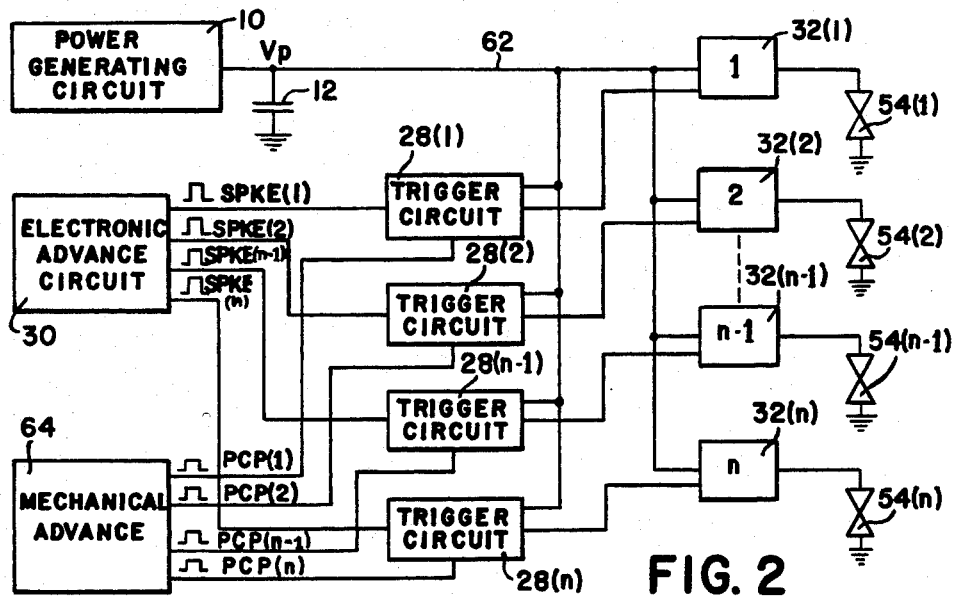
FIG. 2 is a system block diagram of a first multicylinder embodiment of the invention illustrated in FIG. 1 where multiple trigger circuits are used for the ignition of multiple cylinders.

With reference now to FIG. 1, there is illustrated an electronic advance control for a breakerless ignition system. The breakerless system generally includes a power generating section 10 which develops a charging current for a power source such as a discharge capacitor 12. The power section illustrated has an alternator with a rotor coil 14 and a stator coil 16. The stator coil 16 is connected across the inputs of a set of diodes 18, 20, 22 and 24, forming a bridge rectifier. The capacitor 12 is connected to the output of the bridge with one terminal at the junction of the cathodes of diodes 18, 20 and the other terminal at the junction of the anodes of diodes 22, 24. Across the output of the bridge rectifier and parallel to the discharge capacitor 12 a Zener diode 26 is provided for voltage control.

The alternator rotor is driven by the engine at a speed We to generate an alternating output voltage across the stator coil. The alternating output of the stator coil 16 is rectified by the diodes 18, 20, 22, and 24 in each branch of the bridge to convert the alternating voltage into a pulsating DC power signal charging discharge capacitor 12 to a voltage Vp. The Zener diode 26 regulates the voltage on the capacitor 12 to limit the maximum charge on the capacitor to the voltage Vp.

The power generating section disclosed in only one method of charging the discharge capacitor 12. Others include a battery, a DC generator, or similar devices which can be used alone or in combination with an alternator. Further, the alternator can be self contained, such as in a magneto device, or can be belt driven such as in a standard automotive application.

An ignition circuit 32 comprises an ignition coil 38 and a power switching device such as Silicon Controlled Rectifier (SCR) 40. Alternatively, the power switching device could consist of a power transistor or other controlled terminal switching device. The positive voltage terminal of the discharge capacitor 12 is connected to one terminal 36 of the primary of the ignition coil 38. The other terminal 44 of the primary is connected to the anode of SCR 40. The cathode of the SCR 40 is grounded commonly with one terminal 46 of the secondary of the ignition coil 38. The other terminal 48 of the secondary is connected via a high tension conductor 66 to one electrode 50 (preferably the center conductor) of a spark plug 54 having its other (tip) electrode 52 grounded. A trigger conductor 56 electrically joins the gate terminal of the SCR 40 to a trigger circuit 28. The trigger circuit 28 receives a portion of the energy stored in the discharge capacitor 12 as voltage Vp by its connection to a common power conductor 62.

The trigger circuit 28 generates an activation signal or pulse which causes the SCR 40 to conduct when it is desired to ignite the cylinder. Conduction of the SCR grounds the terminal 34 of the primary of the ignition coil dumping the energy stored in discharge capacitor 12 through it in one swift current pulse. The current pulse through the primary of the coil 38 induces a high tension voltage in the secondary thereby firing plug 54.

The trigger circuit combines two timing or trigger signals to generate the activation signal on conductor 56 at the correct phase or angle in an engine cycle at which ignition of plug 54 is desired. The first timing signal PCP is generated by a mechanical timing apparatus 64 which includes a rotating disc 33 with a plurality of magnetic pins 34 and a pickup coil 58. The passage of the pins in proximity to the pickup coil 58 will induce a voltage pulse in the coil. If the disc 33 is rotated synchronously through gearing with the engine at a speed, We, then each passage of a pin will correspond to a predetermined angular position on the crankshaft of the engine. By aligning each pin on the disc with a position on the crankshaft corresponding to a desired ignition advance for a particular cylinder, a timed pulse PCP at that physical position will be output by the pickup coil 58. The pulses PCP indicate when the mechanical activation should cause the triggering of the SCR 40.

A second timing or trigger signal SPKE in the form of a pulse is received by the trigger circuit 28 from an Electronic Control Unit 30 via conductor 60. The ECU 30 preferably can be embodied as a device which measures a number of operating parameters of the engine and outputs a pulse at an optimum point for every cycle of the cylinder being fired. The advance circuit could in an exemplary implementation include a memory for storing a schedule of ignition advance information as a function of the engine parameters being input. The parameter $\theta$ is a timing reference signal to the Electronic Control Unit 30 indicating the actual angular position via conductor 31. Preferably, this timing signal can be developed by a magnetic or optical pickup sensing dsicontinuities in a rotating part of the engine such as the crankshaft, or the flywheel, or the like.

Figure 3:
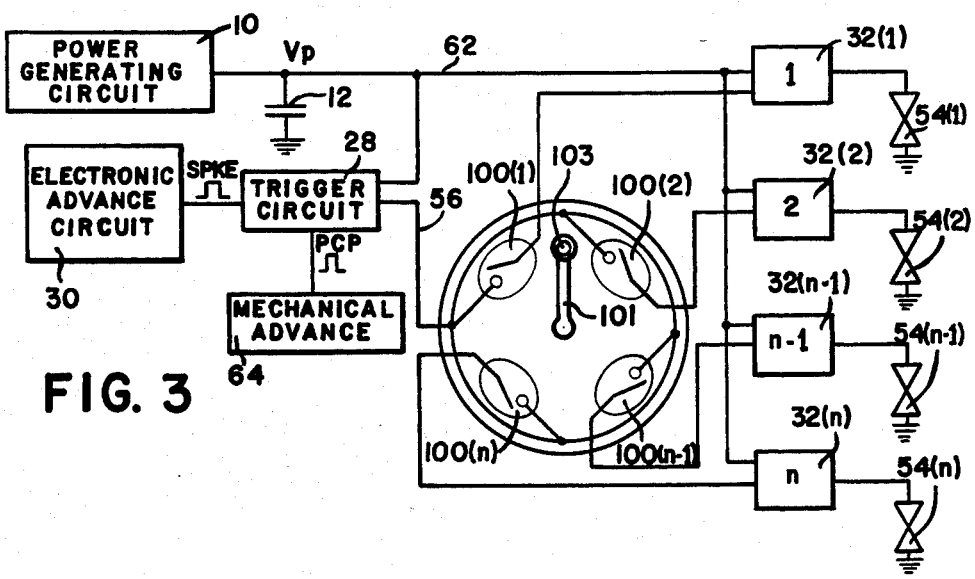
FIG. 3 is a system block diagram of a second multicylinder embodiment of the invention illustrated in FIG. 1 where a single trigger circuit is multiply connected to several ignition circuits for ignition of multiple cylinders by mechanical distribution of the activating pulses to the power switching devices.
Figure 4:
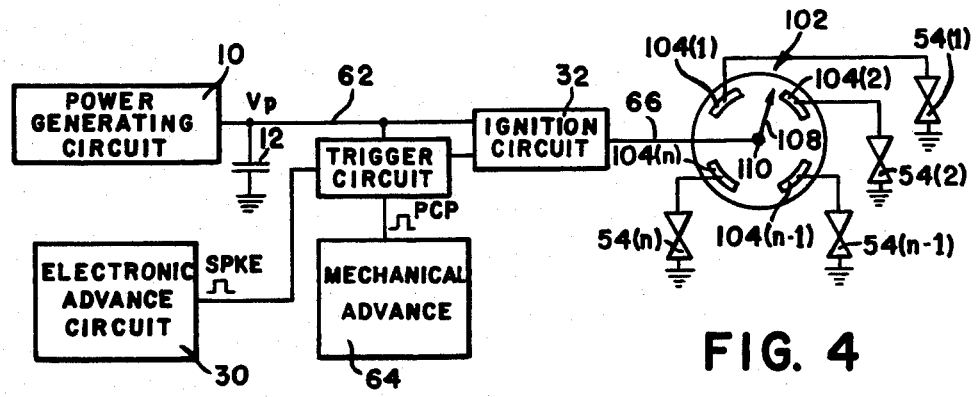
FIG. 4 is a system block diagram of a third multicylinder embodiment of the invention illustrated in FIG. 1 where a single trigger circuit and ignition circuit is used for the ignition of multiple cylinders by mechanical distribution of the ignition circuit.

FIGS. 2, 3, and 4 disclose the system configurations of the advance system illustrated in FIG. 1 for more than one cylinder. With respect to FIG. 2 there is shown a plurality of spark plugs 54(1)–54(n) included in a multiple cylinder engine which are each fired by an associated ignition circuit 32(1)–32(n). The ignition circuits are identical and comprise the elements previously discussed with respect to ignition circuit 32 in FIG. 1. The ignition circuits are activated by a plurality of trigger circuits 28(1)–28(n) which are identical to circuit 28 and are similarly connected as circuit 28 is to ignition circuit 32 in FIG. 1. A power generation circuit 10 and discharge capacitor 12 are further connected identically to each trigger circuit and ignition circuit as is illustrated in FIG. 1. The Electronic Control Unit 30 for this embodiment provides a plurality of electronic trigger pulses SPKE(1)–SPKE(n) which electronically fire associated individual trigger circuts 28(1)–28(n). Further the mechanical advance apparatus 64 generates mechanical triggering pulses PCP(1)–PCP(n) for the individual triggering circuits 28(1)–28(n).

It is seen that timing for firing the multiple spark plugs 54(1)–54(n) is accomplished by electronic distribution of the SPKE pulses and mechanical distribution of the PCP pulses. In this embodiment the mechanical advance apparatus 64 would contain a plurality of pick up coils where each coil would be associated with an individual trigger circuit 28. Each trigger circuit would also correspond to one of the electronic trigger signals SPKE. The electronic trigger signal SPKE(1)–SPKE(n) would be electronically distributed by the Electronic Control Unit 30 from a direct measurement of engine angle and suitable gating circuitry.

In the second multiple cylinder engine embodiment, illustrated to advantage in FIG. 3, there is shown a system including multiple spark plug 54(1)–54(n) each associated with a cylinder of an engine and multiple ignition circuits 32(1)–32(n) each associated with individual spark plugs. A power generating circuit 10, discharge capacitor 12, trigger circuit 28, electronic advance circuit 30, and mechanical advance apparatus 64 are all configured and operate similarly to the identically labeled elements in FIG. 1. The output of the trigger circuit 28 is connected to the primary coil of each ignition circuit 32(1)-32(n) via a set of mechanically operated switches 100(1)–100(n). The switches 100 are of the reed type where their closure is in response to the proximate passage of a magnetic element 103 of rotating arm 101. The element 101 is driven synchronously with the angular rotation of the engine, preferably by the camshaft. The reed switches thereby mechanically distribute the activating signals from the trigger circuit 28 to the appropriate SCRs and primarys of the ignition circuits 32(1)–32(n). The closure of the switches 100 initiates prior to the triggering puses and the opening of the switches is delayed until after they occur because of the configuration of magnetic element 103. This operation forms a time window in which the variable ignition of a particular cylinder can occur.

FIG. 4 illustrates a third multiple cylinder embodiment of the invention similar to FIG. 3. The difference between the two embodiments of FIG. 3 and FIG. 4 is that the system in FIG. 4 has only one ignition circuit. The high tension output on conductor 66 from the secondary of the single ignition circuit is multiplexed by a conventional distributor 102 to multiple spark plugs 54(1)–54(n). The distributor 102 has a wiper 108, rotated synchronously with engine speed, which connects outside terminal areas 104(1)–104(n) to a center terminal 110 in succession as it is rotated. The center terminal 110 is further connected to the high tension conductor 66 of ignition circuit 32. This configuration thereby mechanically distributes ignition pulses from the secondary of the ignition circuit 32 to appropriate spark plugs. The elongated terminal areas 104 operate to form a time window in which the variable ignition point of a particular cylinder can occur.

Figure 5:
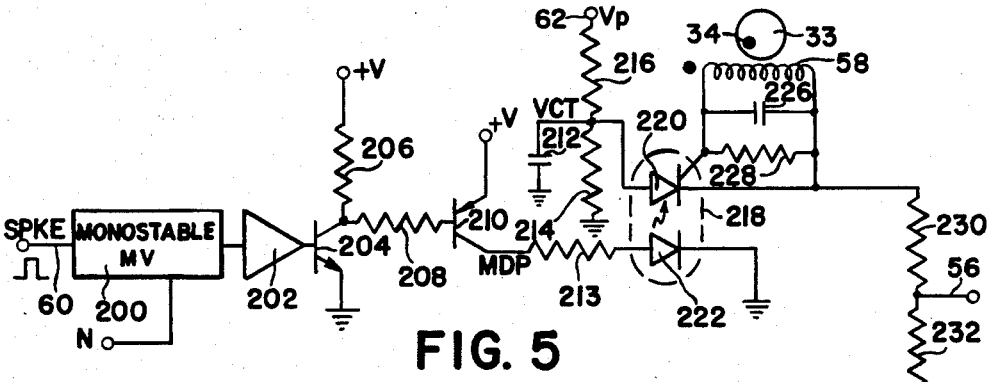
FIG. 5 is a detailed electrical schematic diagram of a first embodiment of the trigger circuit illustrated in FIG. 1.

A first embodiment of the trigger circuit 28 is illustrated in FIG. 5 where the timing pulses SPKE from the Electronic Control Unit 30 are input to a monostable multi-vibrator (MV) circuit 200. The timing pulses produce delay pulses MDP from the monostable MV 200 which are shaped and amplified in a noninverting buffer amplifier 202 before being input to the base of a NPN transistor 204. The transistor 204 functions as an inverter for the delay pulses MDP by having its collector terminal tied to a logic voltage +V through a resistor 206 and its emitter terminal grounded. The inverted delay pulses are subsequently applied from the emitter of transistor 204 to the base terminal of a PNP inverter transistor 210 through a resistor 208. The transistor 210 has its emitter terminal connected to the logic voltage +V and its collector terminal connected to the anode of a light emitting diode (LED) 222 through a current limiting resistor 213. The cathode of the light emitting diode 222 is connected to ground.

Elements 200, 202, 204, 210 form conditioning circuitry which increases the current driving capability of the SPKE pulses from input to output. The conditioning circuitry additionally stretches the electrical pulses SPKE from the Electronic Control Unit for a time period equivalent to the unstable state of the monostable MV 200. The circuitry thereby conditions the delay pulses to current drive the LED 222 into emission and hold the LED in emission for the period of the delay. Monostable 200 may further receive a signal N representative of actual engine speed to modify the unstable state of the MV.

The LED 222 conducts for a period of time equivalent to each delay pulse MDP and triggers an SCR 220 optically coupled to it into conduction for the equivalent period. The LED 222 and SCR 220 in the implementation are integrally contained within an Opto-SCR device 218. The SCR 220 is further capable of being triggered into conduction via its gate terminal by a mechanical activation means connected between its gate terminal and cathode. The mechanical activation means comprises the parallel connection of a resitor 228, a capacitor 226, and the pickup coil 58. The SCR 220 is triggered by the voltage developed across the resistor 228 when a current pulse is induced in the pickup coil 58 by a proximate passage of one of the magnet pins 34.

The anode of SCR 220 is connected to the junction of a voltage divider comprising resistors 214, 216. The resistor 214 and the resistor 216 are connected in series between the common power conductor 62 at voltage VP and ground to form a triggering voltage Vct at their junction. A second power source or triggering capacitor 212 is connected between the divider junction and ground. The divider uses a portion of the discharge or power voltage Vp to charge the capacitor 212 to the triggering voltage Vct. The cathode of the SCR 220 is connected to one terminal of a resistive divider comprising the serial connection of resistors 230, 232 whose other terminal is connected to ground. The junction of the divider is connected to the gate electrode of the SCR 40 (FIG. 1) via the trigger conductor 56.

In operation the trigger circuit 28, during conduction of the SCR 220, acts to discharge the stored energy in triggering capacitor 212 through the resistors 230, 232 of the divider thereby developing a voltage on resistor 232 which is applied between the gate of the power SCR 40 and ground. The applied voltage will trigger the SCR 40 into rapid conduction. The activation of SCR 220 therefore activates SCR 40 to fire the ignition coil. The SCR 220 is triggered into conduction either mechanically by the mechanical activation means or electronically by the LED 222 and the conditioning circuitry in response to the SPKE signal.

FIG. 8*a–c* illustrates timing diagrams of an actual firing of a plug for an engine cylinder according to the invention. In FIG. 8*a* an electronic spark signal pulse SPKE is generated by the Electronic Control Unit 30 between the maximum electronic advance point for the cylinder and the maximum mechanical retard point for the cylinder. This window is generally prior in time to a reference TDCYL(X) indicating top dead center for the cylinder but need not be. The delay pulse MDP, generated from the SPKE pulse, triggers the SCR 220 with its leading edge to activate SCR 40 and fire the cylinder. The electronic ignition of the system, therefore, occurs simultaneously with SPKE pulse. The delay pulse, however, maintains the SCR 220 in conduction for its duration preventing the pickup coil pulse PCP from firing the plug twice. The delay pulse forms an inhibit window in which the mechanical trigger of the mechanical activation means will be masked. The longest inhibit window or delay pulse duration is preferably just longer than the time duration from the maximum electronic advance point to maximum mechanical retard point at the slowest engine speed for which the system is designed. For increased speed, the inhibit window may be modified (shortened) as a function speed to maintain the overlap relationship.

The maximum electrical advance point is the maximum angular advance that can be scheduled for any operating condition of the engine by Electronic Control Unit 30 and the maximum mechanical retard point is the maximum angular retard that can be set by the mechanical advance apparatus. The inhibit window is designed to overlap these two points at any engine speed and mask the mechanical advance pulse PCP if the electronic pulse SPKE is present. It is seen that if the electronic pulse is not present the delay pulse MDP will not be generated and the ignition circuit 32 will be triggered conventionally by the mechanical pulse PCP.

For special conditions such as engine starting where the electronic pulses are inhibited because the operating parameters of the engine can not be measured effectively, the mechanical pulses PCP may be preset to an optimum starting advance. It would be envisioned that the longest delay pulse width would then be adjusted to be just longer than the time period from the maximum electronic advance to the mechanical starting advance at the slowest engine operating speed. For other special conditions such as manual operation, the Electronic Control Unit 30 can be shut off and the mechanical activation means used to ignite the engine.

Figure 6:
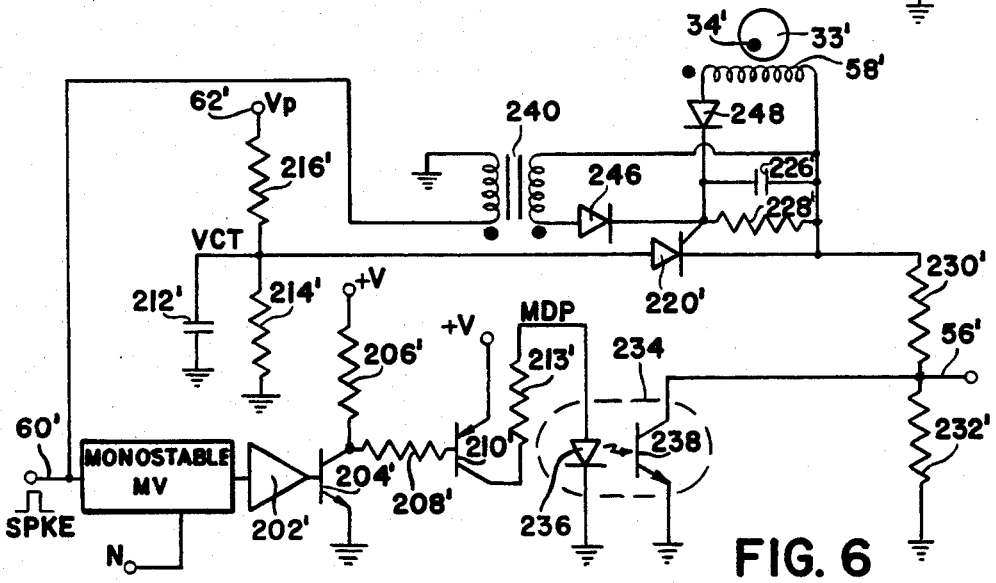
FIG. 6 is a detailed electrical schematic diagram of a second embodiment of the trigger circuit illustrated in FIG. 1.

FIG. 6 is a second embodiment of the trigger circuit 28 in which similar elements corresponding to those in FIG. 5 are marked with identical numerals including a single prime mark. The circuit operates similarly to the circuit in FIG. 5 with the replacement of the opto-SCR 218 by a conventional SCR 220' which can be dual triggered. For a reduction in the triggering current necessary to fire the activation device, the SCR 220' could be replaced by a Silicon Controlled Switch (SCS). The SCR 220' is connected between a power source comprising resistors 214', 216', and capacitor 212' and a divider comprising resistors 230', 232' as previously described. One trigger of the SCR 220' is accomplished by a mechanical activation means including the parallel connection of resistor 228', capacitor 226', and pickup coil 58' between its gate and cathode electrodes. The second trigger is electronic and generated by the connection of the secondary of one-to-one pulse transformer 240 between the cathode and gate electrodes of the SCR 220'. The primary of the pulse transformer 240 is connected between the conductor 60' receiving the electrical triggering signal SPKE and ground. Properly poled steering diodes 246, 248 have been added between the positive terminal of the coils of 58', 240, and the cathode of the SCR 220' to ensure development of a voltage across the resistor 228' without dissipation of the triggering pulses in the other coil.

A conditioning circuit comprising monostable MV 200', amplifier 202', transistors 204', 210', and resistors 206', 208' generates delay pulses in a manner identical to that described previously. The delay pulses are applied to an LED 236 causing it to conduct during the period of the pulse. The LED 236 is one half of an opto-transistor 234 and is optically coupled to a photoresponsive NPN transistor 238 comprising the other half. The transistor 238 has its collector terminal connected to the trigger conductor 56 of SCR 40 (FIG. 11) and its emitter terminal connected to ground.

The circuits illustrated in FIGS. 5 and 6 are functionally equivalent where an electronic spark pulse SPKE will trigger SCR 220' into conduction via the pulse transformer 240. The energy stored in capacitor 212' will cause a voltage rise across resistor 232' and fire SCR 40 (FIG. 1). The delay pulse MDP generated by the monostable MV 200' will cause the transistor 238 to ground the gate terminal of SCR 40 and hold the SCR in conduction to mask the mechanically generated pulse PCP from pickup coil 58'.

Figure 7:
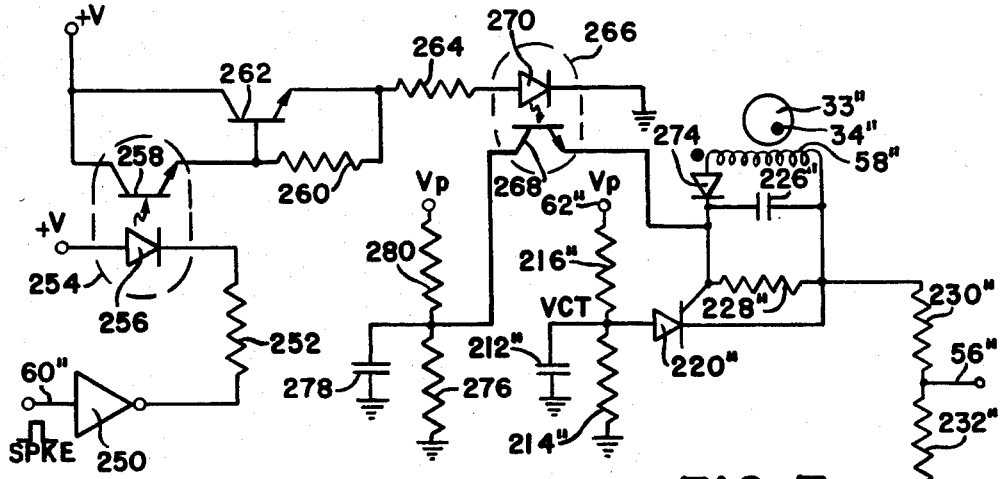
FIG. 7 is a detailed electrical schematic diagram of a third embodiment of the trigger circuit illustrated in FIG. 1.

In FIG. 7 a third embodiment of the trigger circuit 28 is shown to advantage where similar elements corresponding to those in FIGS. 5 and 6 are marked with identical numerals including a double prime mark. SCR or SCS 220'' replaces the SCR 220 of FIG. 5 but operates similarly to provide a conduction path from capacitor 212'' to the resistive divider formed of resistors 230'', 232'' when it is triggered either electronically or mechanically.

The SCR 220'' is triggered electronically and mechanically by separate means. The mechanical trigger is generated, in the manner previously described, by the parallel combination of pickup coil 58'', capacitor 226'', and resistor 228''. The electronic trigger for SCR 220'' is generated by an opto-transistor 266 and a conditioning circuit including inverter 250, opto-transistor 254, and NPN transistor 262. The opto-transistor 266 includes a photosensitive NPN transistor 268 with its emitter terminal connected to the gate terminal of the SCR 272 and its collector terminal connected to the junction of a resistive divider formed of resistor 276 and a resistor 280. The divider is connected between the power voltage Vp and ground and supplies a fraction of that voltage at its junction. A capacitor 278 is connected between the divider junction and ground to store energy at that fractional voltage.

The transistor 268 is optically coupled to the other half of the opto-transistor 266, an LED 270 whose cathode is grounded and whose anode is connected to the emitter terminal of the transistor 262 through a current limiting resistor 264. The collector terminal of the transistor 262 is connected to a source of logic voltage +V. The base terminal of transistor 262 is connected to the emitter terminal of a photosensitive NPN transistor 258 which is one half of opto-transistor 254. The emitter terminal of transistor 258 further is connected to the base terminal of transistor 262 and to its emitter terminal through resistor 260 while having its collector terminal connected to the voltage source +V. The other half of the opto-transistor 254 is an LED 256 having its anode connected to the voltage source +V and its cathode connected to conductor 60'' through the serial connection of an inverter 250 and a current limiter resistor 252.

When an electronic advance signal pulse SPKE is applied to terminal 60'', through the serial connection of inverter 250 and current limiter resistor 252, the output of the inverter goes to a low logic level sinking current from the source +V through the resistor 252 and diode 256. The conduction of current through diode 256 produces a radiation emission which causes transistor 258 to saturate, thereby turning on transistor 262 and thus applying the source voltage +V to the series path of resistor 264 and LED 270.

As current is drawn through the LED 270 it emits radiation and saturates transistor 268. By saturating transistor 268 a conductive path is formed between the capacitor 278 and the resistor 228''. A voltage is developed across the resistor 228'' as the energy in capacitor 278 discharges through it triggering the SCR 220'' into conduction. The conduction of SCR 220'' completely discharges the capacitor 212'' through divider resistors 23'', 232'' and thus fires power SCR 40 (FIG. 1).

The timing waveform diagrams of FIGS. 8*d, e, f,* will now be referenced to more fully describe the interaction of the double triggering circuits for the embodiment illustrated in FIG. 7. The electronic advance pulse SPKE shown in FIG. 8*d* triggers the SCR 220'' into conduction by means of the transistor 268 to fire the power SCR 40 and discharge capacitor 212''. The triggering voltage Vct on the capacitor 212'' illustrated in the waveform of FIG. 8*e* begins to rise at an exponential rate with its characteristic RC time constant after it is discharged by the signal pulse SPKE. However, the capacitor voltage will not reach a firing voltage Vfv which is necessary to apply to the anode of the SCR 272 before that device can be triggered until point 112 after the pickup coil pulse PCP is overlayed. This delay T1, equivalent to the length of the delay pulses, thus precludes double firing of the power SCR 40 in a single cycle by the mechanically generated trigger.

The longest delay time period is preferably slightly longer than the period the engine will take traveling from the maximum electronic advance position to the maximum mechanical retard position at the slowest speed at which the electronic advance is used. Alternatively, the longest delay time can be set just slightly longer than the time period (at the slowest engine speed) between the maximum electrical advance point and the advance set mechanically when not at maximum retard.

The optically coupled devices 218, 234, 256, and 266 in FIGS. 5, 6, and 7 provide noise isolation of the drive components they actuate. This operation prevents triggering of the drive components in response to noise instead of the controlled activating pulses.

While the preferred embodiments of the invention have been shown and described, it will be obvious to those skilled in the art that various modifications and changes may be made thereto without departing from the spirit and scope of the invention as hereinafter defined in the appended claims.

What is claimed is:

1. In a breakerless ignition system for an engine, said engine having a crankshaft, said ignition system having an ignition coil with a primary winding for receiving a controlled pulse of power and a secondary winding for transforming the power pulse into a high voltage capable of arcing across the gap between the electrodes of a spark plug; a controlled switch connected between a power source and the primary winding, said control switch including a control electrode; a mechanical activating means including a physical timing member rotatable with said crankshaft; and activating means, connected to the control electrode, for activating the controlled switch during a first time period ending at a maximum retard condition of said mechanical activating means in response to said physical timing member attaining a predetermined angular position; said system further comprising an electronic advance control including:

means for generating electronically timed pulses coincident with a scheduled firing advance for the controlled switch;

means, connected in parallel with the controlled switch activating means, for activating the controlled switch in response to said timed pulses;

means for delaying the deactivation of the controlled switch for a time period ending after said first time period ends.

2. An electronic advance control as defined in claim 1 wherein the controlled switch is an SCR and said delaying means includes:

a monostable multivibrator triggered into a unstable state by said timed pulses and reverting to a quiescent state after the unstable state period has expired; and means, activated during the unstable state of said monostable multivibrator, for grounding the gate electrode of the SCR.

3. An electronic advance control as defined in claim 2 wherein the activating means includes a second SCR and a pickup coil connected between the gate and cathode of said SCR and wherein said electronic activating means includes:

a pulse transformer with its secondary connected in parallel with said pickup coil between the gate and cathode of said second SCR and its primary connected to said timed pulse generating means.

4. An electronic advance control as defined in claim 2 wherein said grounding means includes:

an optically coupled transistor of the NPN type having a photo transistor with its collector electrode connected to the gate electrode of said SCR and its emitter electrode connected to ground, and further having an LED with its anode electrode connected to the monostable multivibrator and its cathode electrode connected to ground.

5. A breakerless ignition system including:

a plurality of ignition circuits each associated with a plurality of spark plugs of a multicylinder engine;

a power source;

a plurality of controlled switching devices disposed between the ignition circuits and the power source, said controlled switching devices connecting said power source to said ignition circuits to produce a spark across said spark plugs in response to a plurality of activation signals;

a plurality of triggering circuits each adapted to generate said activation signal in response to either an electrical trigger signal or a mechanical trigger signal, said trigger circuits additionally masking said mechanical trigger signal and not generating said activation signal if said electrical trigger signal is present;

an electronic means for generating a plurality of electrical trigger signals wherein each electrical trigger signal is associated with an individual trigger circuit and provides a scheduled pulse at an optimum ignition time of an associated cylinder; and a mechanical means for generating a plurality of mechanical trigger signals wherein each mechanical trigger signal is associated with an individual trigger circuit and provides a pulse at a scheduled ignition time for an associated cylinder.

6. A breakerless ignition system including:

a plurality of ignition circuits each associated with a plurality of spark plugs of a multicylinder engine;

a power source;

a plurality of controlled switching devices disposed between the ignition circuits and the power source, said controlled switching devices connecting said power source to said ignition circuits to produce a spark across said spark plugs in response to a plurality of activation signals;

means for mechanically distributing an activation signal to said plurality of controlled switching devices, said distributing means forming time windows during which an activation signal for a particular cylinder can occur;

a trigger circuit for generating said activation signal in response to either an electrical trigger signal or a mechanical trigger signal, said trigger circuit overriding said mechanical trigger signal;

an electronic means for generating said electronic trigger signal to provide a scheduled pulse at an optimum time for a cylinder during its distribution window; and a mechanical means for generating said mechanical trigger signal to provide a scheduled pulse at a predetermined time for a cylinder during its distribution window.

7. A breakerless ignition system including:

a plurality of spark plugs of a multicylinder engine;

a power source;

an ignition circuit;

a controlled switching device disposed between said ignition circuit and said power source, said switching device connecting said power source to said ignition circuit to produce a high voltage pulse in response to an activation signal;

means for mechanically distributing said high voltage pulse to said spark plugs, said distributing means forming time windows during which a high voltage pulse for a particular cylinder can occur;

a trigger circuit for generating said activation signal in response to either an electrical trigger signal or a mechanical trigger signal, said trigger circuit said mechanical trigger signal;

an electronic means for generating said electronic trigger signal to provide a scheduled pulse at an optimum time for a cylinder during its distribution window; and a mechanical means for generating said mechanical trigger signal to provide a scheduled pulse at a predetermined time for a cylinder during its distribution window.

* * * * *